United States Patent [19]

Fossati et al.

[11] Patent Number: 4,726,450

[45] Date of Patent: Feb. 23, 1988

[54] HYDRAULIC ELEVATOR WITH DYNAMICALLY PROGRAMMED MOTOR-OPERATED VALVE

[75] Inventors: Giorgio Fossati; Harold Terry; Giuseppe Manco, all of Milan, Italy

[73] Assignee: Otis Elevator Company, Farmington, Conn.

[21] Appl. No.: 853,285

[22] Filed: Apr. 17, 1986

Related U.S. Application Data

[63] Continuation-in-part of Ser. No. 799,666, Nov. 18, 1985, abandoned.

[51] Int. Cl.[4] ..... B66B 1/04

[52] U.S. Cl. ..... 187/111

[58] Field of Search ..... 187/110, 111

[56] References Cited

U.S. PATENT DOCUMENTS 3,977,497 10/1976 McMurray ..... 187/111

4,249,641 2/1981 Takenoshita et al. ..... 187/111

4,311,212 1/1982 Simpson ..... 187/111

*Primary Examiner*—William M. Shoop, Jr.

*Assistant Examiner*—W. E. Duncanson, Jr.

[57] ABSTRACT

The point at which pump out pressure exceeds load is sensed to provide a point for scheduling flow to an actuator in a hydraulic system. Flow is controlled by a stepper motor (28) that moves a flow control valve (27). The steps needed to achieve fixed flow changes are greater for high flow positions. When the pump (21) is turned on, the valve (27) is positioned to bypass flow; the bypass flow is then programmably decreased to the actuator. Reverse flow is regulated by the valve (27) to control actuator retraction. Reverse flow is initiated by opening a check valve (40) with an actuator (50) that opens it first to reduce pressure across the valve, then fully. The flow control valve (27) also operates to relieve excess pressure in the system. During a descent the stepper rate is started at a first stored rate for worse conditions, the car velocity is measured and successive stored rates are increased or decreased.

5 Claims, 6 Drawing Figures

HYDRAULIC ELEVATOR WITH DYNAMICALLY PROGRAMMED MOTOR-OPERATED VALVE

This is a continuation-in-part of Ser. No. 799,666, filed Nov. 18, 1985 now abandoned.

CROSS-REFERENCE TO RELATED CASES

This application shows apparatus described and claimed in the application titled "Pressure-Referenced Programmed Flow Control in a Hydraulic Valve", U.S. Ser. No. 799,665, and the application titled Pressure Relieving Linear Motion Valve, U.S. Ser. No. 799,765, by the same inventors and also assigned to the same assignee, Otis Elevator Company.

TECHNICAL FIELD

This invention relates to hydraulic elevators.

BACKGROUND ART

In an attempt to control a hydraulic elevator with precision approximating the more sophisticated and usually more expensive traction elevators, feedback control is used. But, even using feedback control, comparable performance has been difficult to achieve. The main problem is the dynamic characteristics of the fluid. The fluid viscosity shifts with ambient temperature and also from the heating that occurs as the elevator car is raised and lowered. These variables produce some measure of unpredictability in the motion of the elevator car. Different levels of feedback have been utilized, but typically these approaches are expensive and lower system efficiency because they require excess pump capacity.

A technique illustrating feedback is shown in U.S. Pat. No. 4,205,592, where the flow through the valve and to an object, such as a hydraulic elevator, is passed through a flow meter that includes a potentiometer. As the flow increases, the output voltage associated with the motion of the potentiometer wiper changes, manifesting the magnitude of the flow. U.S. Pat. No. 4,381,699 shows a similar type of valve control.

U.S. Pat. No. 4,418,794 is illustrative of the type of valve that may be used in systems that do not sense the fluid flow but, using a larger feedback loop, perhaps sense the position of the elevator car and control the operation of the valve.

DISCLOSURE OF INVENTION

According to the present invention, a linear flow control valve is operated by a stepper motor to control flow between the pump and the elevator hydraulic cylinder when the car is raised and the return flow from the cylinder to the tank when the car is lowered. The time-related motion of this valve mirrors the flow to the car, thus also the car's velocity profile. The operation of the valve begins by placing it in a position at which the fluid from the pump is completely bypassed from the car. The valve is then progressively closed, decreasing that bypass flow. When the pressure applied to the elevator car exceeds the pressure required to sustain the car, motion of the valve is programmed to the desired elevator velocity profile.

According to one aspect of the invention, the motor responds to a pulsed drive signal. The motion of the valve is programmed by changing the frequency of that signal as a function of the valve position, which is determined by the aggregate number of pulses applied to the motor.

The pressure differential that arises when the output pump pressure just exceeds the pressure required to hold the car in place is sensed from the motion of a check valve across which the pump pressure and car pressure are oppositely applied. Movement of the check valve to an open position at which the car will just about start to move is detected by an electrical switch that produces an electrical control signal that is applied to the main valve control. That control signal acts as the starting point for main valve programmed positioning that determines the velocity profile of the elevator car when the car is moved up. When the car descends, the valve is initially opened at a rate suitable for a heavy car and hot fluid. If the actual velocity of the car is less than expected for those conditions, the frequency of the subsequent signals to the stepper motor are increased proportionally, and the final velocity is greater, which adjusts for the different flow characteristics that happen if the fluid is cool or the car is light.

During the down run, the valve is repositioned as a function of the actual car speed as compared to a desired speed. If positioning the valve does not change the car speed, which can happen if the car is very light, the valve is progressively opened until a reduction in the speed is sensed. The valve is then held at that position.

There are many features to the present invention. Most significant, it provides very precise performance because the fluid and load characteristics control the operation of the valve. Yet, it is simple and reliable because feedback is used selectively to adjust for those characteristics. For the most part, the valve flow is controlled without feedback.

BEST MODE FOR CARRYING OUT THE INVENTION

Figure 1:
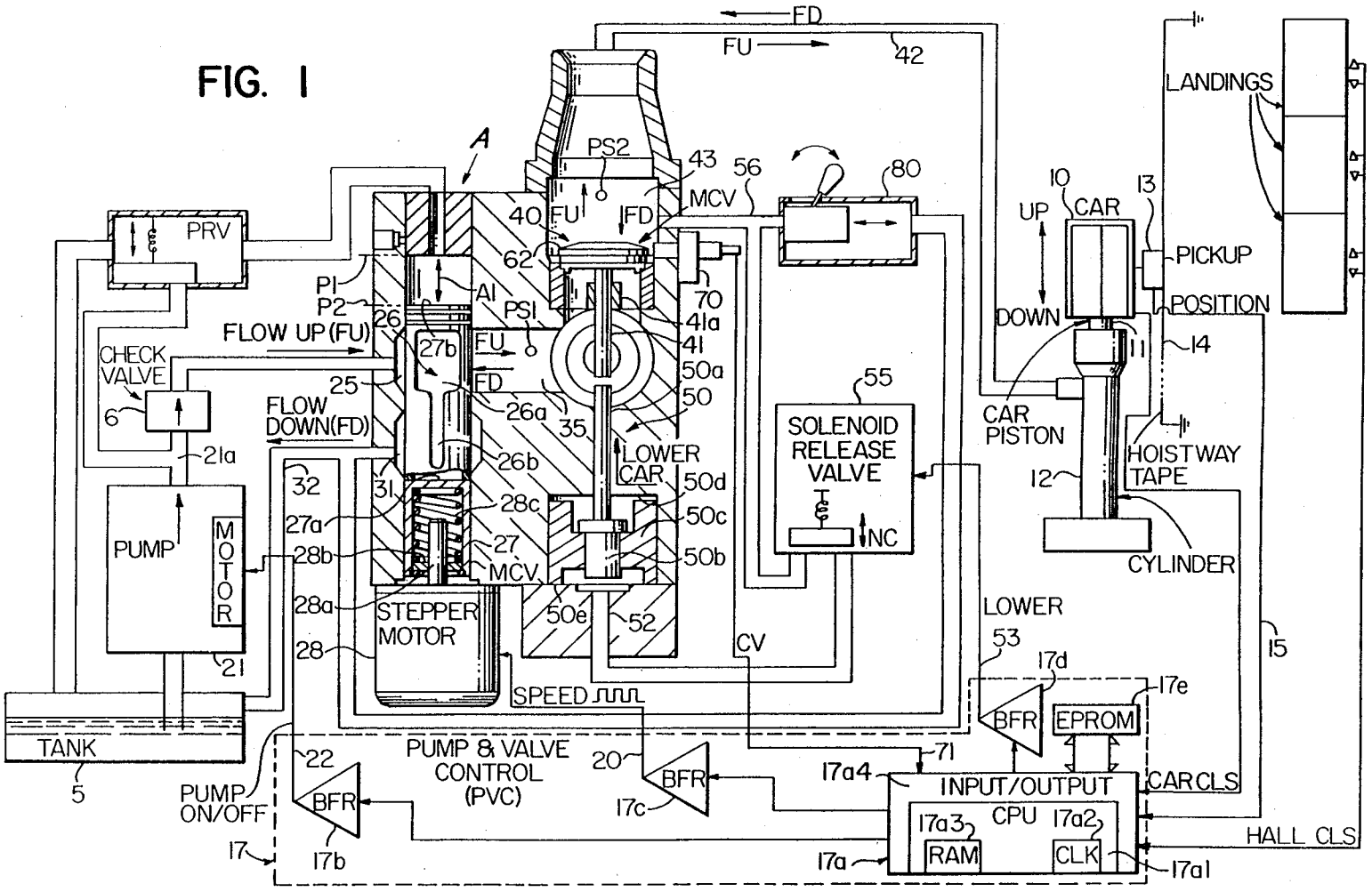
FIG. 1 is a a functional block diagram of an elevator control system that includes a hydraulic valve according to the invention. It includes a sectional view of that valve.

FIG. 1 shows a hydraulic elevator control system for moving an elevator car 10 between a plurality of floors or landings. The floors or landings are not shown. The car is attached to a car piston (plunger) 11 that extends from a cylinder 12, and fluid is pumped into or discharged from the cylinder to raise and lower the car respectively, that flow being controlled and regulated in a manner that will be described in detail. The motion of the car is detected by a pickup 13. Associated with a stationary position tape 14, the pickup provides a signal (POSITION) on line 15, that is supplied to a pump and valve control (PVC) 17. The POSITION signal manifests the car position and velocity. The position of the car thus sensed is used for controlling the flow of fluid between the cylinder, controlling the position of the car piston or plunger 11. The PVC 17 controls a hydraulic valve system that includes a pump 21 and a fluid reservoir (tank) 5. The pump supplies fluid to a hydraulic control valve assembly through a check valve 6 (to prevent back flow), and this assembly is controlled, along with the pump, by the PVC 17. The pump is turned on or off (activated/deactivated) by a pump ON/OFF signal on a line 22, and the fluid from the pump is applied under pressure through the check valve 6 to a first port 25.

The port 25 leads to a "key-shaped" valve window 26 that is part of a linear valve 27, one that moves back and forth linearly between two positions P1, P2, it being fully "open" at P2 and fully "closed" at P1. The position of the valve 27 is controlled by a stepper motor 28 which receives a signal (SPEED) on the line 29 from the PVC 17. That signal comprises successive pulses, and the frequency of those pulses determines the motor's 28 speed, hence also the longitudinal (see arrow A1) rate of positioning of the valve 27. Each pulse in the SPEED signal represents an incremental distance along the length of motion of the valve 27 between points P1 and P2. The position (location) of the valve is represented by the accumulated count between those positions. The valve window 26 comprises a large window **26*a* and an adjacent narrower window 26*b*, giving it a "key-shaped" appearance. At one point, P2, the large window 26*a* is adjacent the first inlet port 25, and the narrower adjacent portion 26*b* is located next to a second port 31. At this point, the valve 27 is "open". That second port 31 leads to a line 32 that goes to the tank 5. At position P1, the small window 26*b* is mostly adjacent to the port 25, and the path to the port 31 is blocked by the solid part of the valve. At that position, the valve 27 is "closed". In the open position, at P2, fluid flows from the pump through the line 24; this is "flow-up" (FU), flow to raise the car. The fluid then passes into the large window 26*a* and, from there, through the small window 26*b* back to the line 32, then to the tank. The FU flow is thus bypassed when the pump is started. But, as the valve 27 closes (moves to position P1), the pressure of the FU fluid flow begins to build in an internal port 35, while the bypass flow on line 32 decreases as the path through window 26*b* to port 31 decreases. As the valve 27 moves to position P1 (nonbypass position), there is some overlap of the two windows 26*a*, 26*b* and the main inlet port 25, meaning that the path through the large window 26*a* decreases, while the path through the smaller window 26*b* increases. But, the area of the smaller window 26*b* is more dependent than with the case of the larger window on the longitudinal position of the valve 27. As a result of this, the change in flow is controlled by the smaller valve window area to outlet port 31, which reduces as the main valve begins to move towards the closed position at P1, at which all the FU flow passes from the port 25 to the inlet 35; there being no path between the port 25 and the outlet port 31**.

The fluid pressure PS1 in the internal port 35 is applied to a main check valve (MCV) 40. This valve has a small stem 41 that rests in a guide **41*a*. The MCV may freely move up and down in response to the pressure differentials between the port 35 and the port 43, where the pressures are PS1 and PS2, respectively. When the pump is turned on and the main valve 27 closes, moves towards position P1, the MCV 40 is pushed upward when PS1 exceeds PS2, allowing the FU flow to pass through the MCV into the line 42 that extends to the cylinder 12. This happens as the bypass flow decreases. The resultant fluid flow displaces the car piston 11** upward, moving the car in the same direction.

When the car 10 is at rest, pressure in the line 42 and the pressure in the chamber 44 are the same, pressure PS2. With the pump 21 off, this pressure pushes the MCV 40 down, and the down flow (FD) in the line 42 is then blocked, holding the car 10 in position. No flow through the line 42 and back to the tank 5 is possible under this condition. To allow this flow to occur, the MCV 40 must be lifted, and this is effected by the operation of a main check valve actuator 50.

This actuator includes a rod **50*a*, which contacts the stem 41 when pushed upward; a first member 50*b* which is pushed upward against the rod; a second member 50*c* which when pushed upward moves the first member. The rod 50*a* is thrust upward, pushing the MCV 40 upward, when fluid, at pressure PS2, is applied to the inlet line 52, and that happens only when a LOWER signal is applied to the line 53 that goes to a solenoid control release valve 55. The fluid pressure in the line 52 is then applied to the bottom of the members (pistons) 50*b*, 50*c*. The combined surface area of those members is greater than the upper surface area 62 of the valve 40. The second member moves until it strikes the wall 50*d* of the chamber 50*e*. The first member also moves with the second member because of the flange 50*e*. This small motion (as far as the wall 50*d*) "cracks" open the MCV 40, equalizing the pressures PS1 and PS2. Then the first member continues to move upward, until it too strikes the wall, fully opening the MCV 40. This allows return flow (CFD) from the chamber 35 that passes through the windows 26*a*, 26*b*, and line 32. The FD flow through line 25 is blocked by the check valve 6. The position of the valve 27** determines the rate of the FD flow, thus the speed profile of the car as it descends. The valve is moved from the closed P1 position by the SPEED signal towards the open position P2. The duration and frequency of the SPEED signal sets the down velocity profile.

There is switch 70 that is adjacent the MCV 40, and the upward motion of the MCV 40 causes the switch to operate. That operation provides a signal (CV) on the line 71 going to the PVC 17. The CV signal shows that the valve in the up direction for elevator travel has moved. It represents that the pressure in the chamber 35 has slightly exceeded the pressure in the chamber 43. Using this signal, the PVC may control the further motion of the valve spool by controlling the pulse rate and duration comprising the SPEED signal, which is applied to the line 29. The CV signal occurs just when the pressure of PS1 35 exceeds the pressure PS2, and that occurs just before there is actual flow. Generation of the CV signal consequently provides a definitive manifestation of "anticipated" flow.

The stepper motor controlled valve 27 also provides a pressure release function for the port 35. The stepper motor 28 has an output link **28*a*, and a collar or ring 28*b* is attached to that link. The link and collar fit in a hollow portion of the valve 27 but separated from the flow area (windows 26*a*, 26*b*) by the valve wall 27*a*, which is opposite another wall 27*b*. (The valve 27 is shaped like a hollow cylinder; fluid flows through its interior.) A spring 28*c* fits between the wall and the collar 28*b*. As the stepper motor operates, the link moves up or down, in steps corresponding to the steps in the SPEED signal. This motion is transmitted to the wall 27*a* through the spring to the valve 27, which moves in synchronism with the link. If the pressure in the pump output line 21***a* is sufficient to operate the pressure release valve (PRV), the pressure is applied to the top of the valve 27*b*, the entire valve 27 is forced down, allowing the flow from the pump to press through the line 32, to the tank 5, to relieve the "overpressure" condition.

For manually lowering the car, a manually operated valve 80 is operated to allow the fluid to flow from the chamber directly back to the tank 5.

Figure 2:
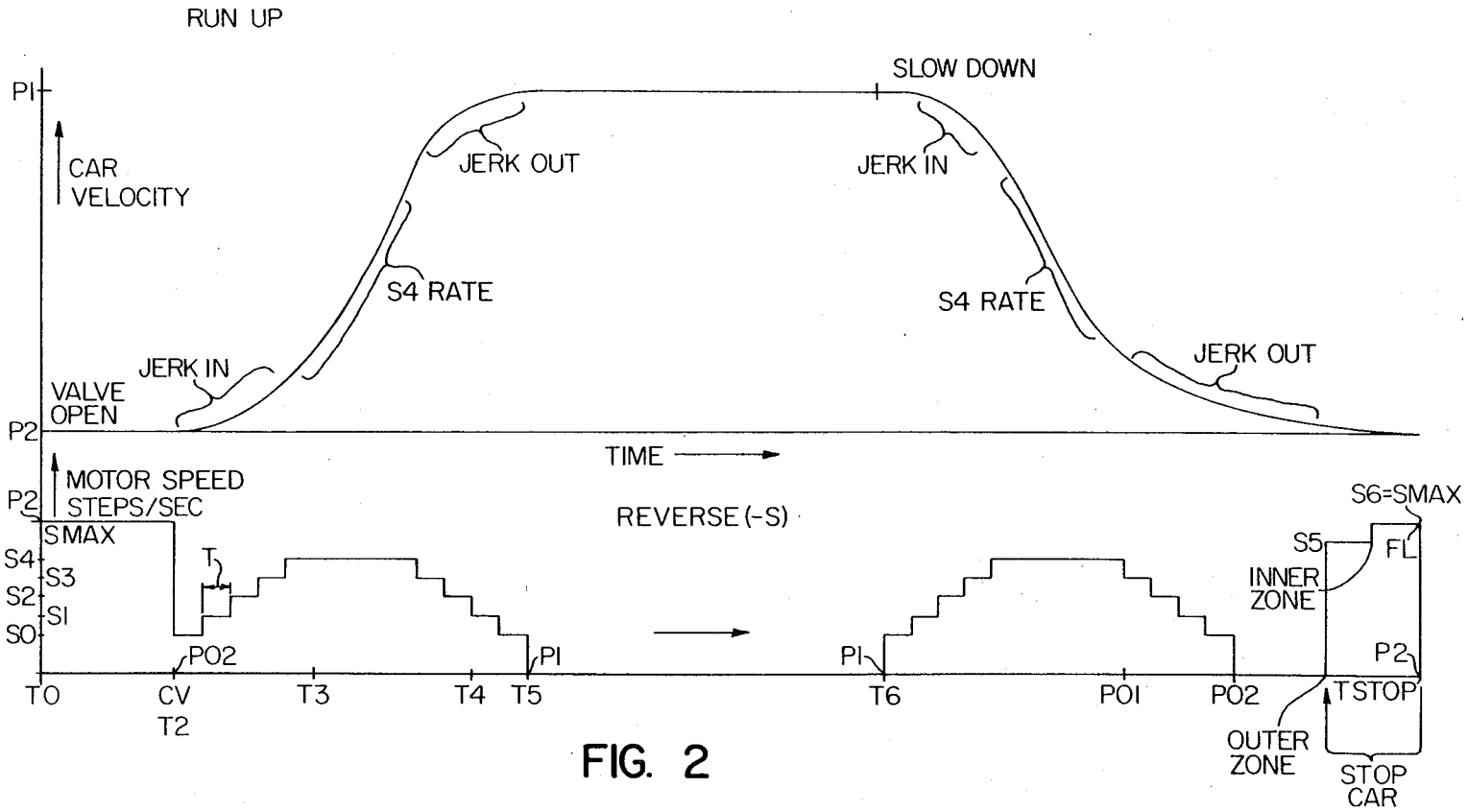
FIG. 2 is two waveforms on a common time base. One shows the car velocity between two floors for an elevator up call. The other waveform shows the stepper motor drive signals provided to the valve stepper motor to produce that car velocity profile.

FIG. 2 shows the car velocity and the SPEED signal for a "run-up" elevator operation, the elevator response to an up call. The pump is originally turned on at time T0, and just prior to that the linear valve is placed in the fully open position P2. The pump is started at T0 and the valve is opened at an initial velocity rate of a certain number of steps per second (SO). As used hereinafter, "S" refers to the SPEED signal rate, and "SN" means individual rates where N ranges from zero to four. S4 is a higher rate than S0. The linear valve opens at a constant rate determined by the frequency of SMAX. At time T2, the CV signal is received, and at that time the valve has been moved to position P02. The rate is then reduced to S0, which lasts for a predetermined duration of time T. The rate then advances to a predetermined higher rate S1, which lasts for a predetermined duration of time T, as did S0. After that initial period of T, the rate advances to yet another higher rate S2, which is also for T. The rate advances after each interval of T through S3, finally ending at the rate S4, which is the preset maximum acceleration/deceleration rate for the car. S1, S2 and S3 determine the jerk-in characteristics. The position of the valve at any point is known by counting the number of steps that occurred since T0. The valve position at which constant acceleration/deceleration takes place shifts somewhat because the duration of the S0 rate is determined by the difference between T0 and T2, and that is a function of the fluid characteristics.

At time T4, the S4 rate is discontinued, in favor of the lower rate S3. The time T4 obviously corresponds to a valve position defined by the number of steps made since T0. In discrete time steps of T, the rate is decreased through S3 to S0, until the rate is zero at time T5. This defines the acceleration jerk-out. Roughly between the times T5 and T6, the car is moving at a constant velocity, which is VMAX. The valve is fully open, at position P1, and all the FU flow is directed to the cylinder. There is no bypass flow. At time T6, a slowdown signal is received. It is obtained from a device in the shaft and marks the physical point at which the deceleration into the landing should begin on the up run. It may also be obtained from the POSITION signal.

At this point, the valve must gradually be moved to the open position (bypassing the FU flow to the tank) to reduce car velocity with acceptable jerk-in, jerk-out, and deceleration rates. In the run-up position, the range of travel between P0 and P1 is again utilized. The jerk-in phase for deceleration, which begins some slight time after the slowdown signal, starts by immediately moving the valve towards the open position at the rate S1, but reversed (opposite polarity), because the valve must be opened, moved towards position P2. Then, after time T, the rate is progressively increased after each increment of T until the final rate of S4 is reached, at which the car is decelerating at a constant rate determined by the rate of S4. Then, when the valve is at position P01, the rate is decreased from S4 back to S0. At position P02, it is decreased to zero; the motor is stopped. But, at position P02, the valve is slightly open, roughly by the distance DP, due to the delay, until the CV signal was produced. Because of this, the car creeps to the floor at a slow rate because some of the pump output is applied to the cylinder. When the outer door zone at the landing is reached, the valve is closed at a high rate S5, then at a higher rate S6 at the inner door zone. When the car is level, the pump motor is stopped. The valve is fully open at that point.

A run-down from a floor involves a different procedure, because the velocity of the car is equal to the flow-down (FD) velocity, and that is controlled entirely by the positioning of the linear valve. (In the up direction, the maximum velocity is determined by the pump output.)

Figure 3:
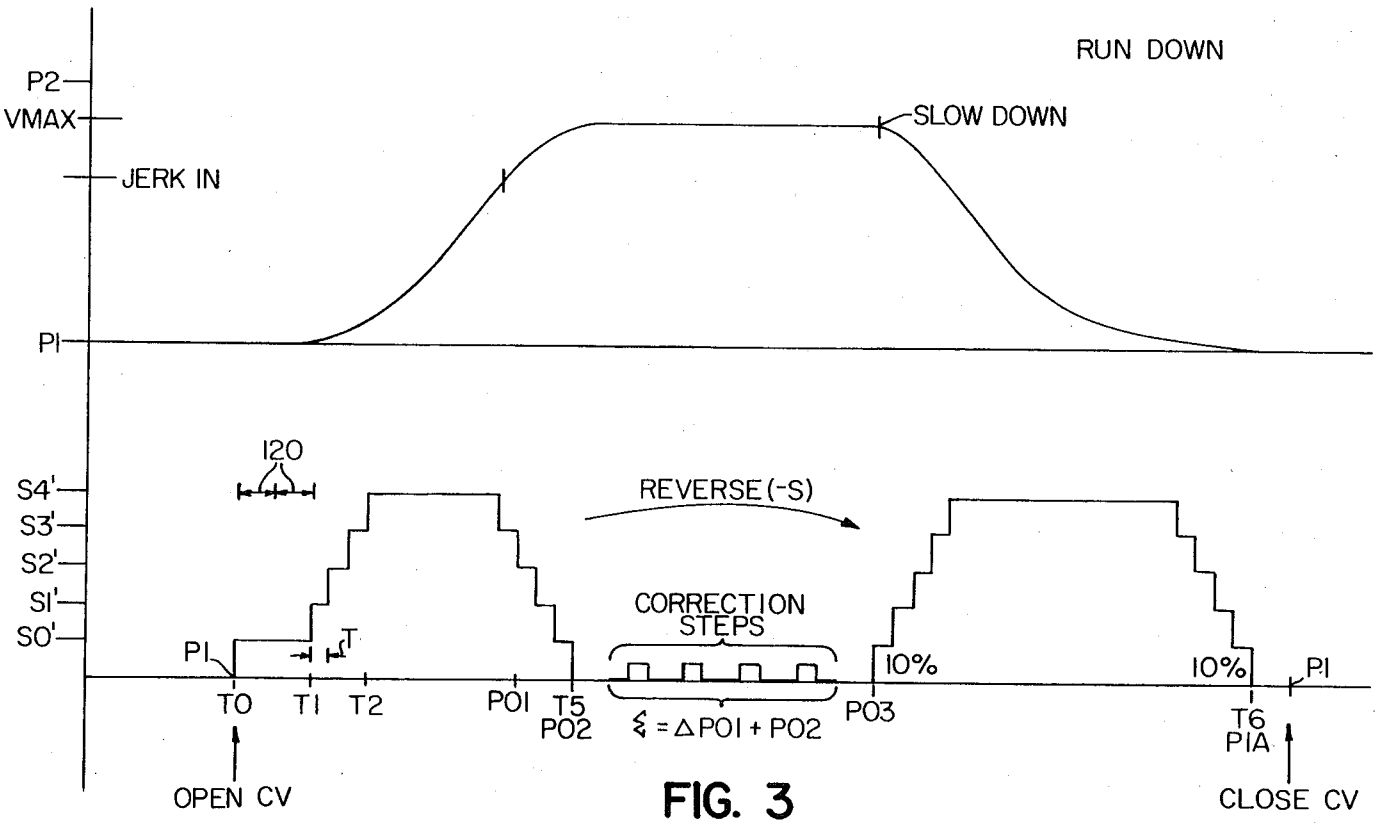
FIG. 3 has the same waveforms but for an elevator down call.

A run-down is shown in FIG. 3. The run-down begins by positioning the valve in the closed position at P1. At that position there is no flow back through the pump because of the check valve. The FD flow path through line 32 is blocked by the location of the linear valve. The MCV valve 40 is pushed up in response to the production of the LOWER signal that is provided to the solenoid release valve 55. This produces the CV signal, and in response the valve is moved from P1 to P2 at an initial rate −S0 (reversed to move the valve open). The car then begins to move and the POSITION signal from the pickup is provided. At two equal intervals 120 milliseconds apart between the time T0 and T1 (during which the stepper motor speed is held at S0), the speed of the car, that is, its downward velocity, is measured from the POSITION signal and compared with a maximum car velocity. The SO rate is the worst case rate: the rate assuming that the fluid is hot and that the car is fully loaded. Thus, S0 is lower than it would be if the car were light or the fluid were cold. If the velocity of the car is below what would be expected, which indicates that the car is either light or the fluid is cold or both, then S1 through S4 are increased or decreased in proportion to the over or underspeed. The comparison yields two velocity error signals (VERR), and the average of the two is used to recalculate the rates, which are identified as S0'–S4'. Between time T1 and T2, the motor is progressively advanced in equal time stages of T between S1' and S4', which is the final acceleration rate. The rate stays at S4' until time T3. Then, the rate decreases from S4' to 0 by time T5; T3 also defines the valve position P01, at which the car is at 90% of its maximum velocity (VMAX). Following this process, the valve is brought to a final position at which the FD flow is about 90% of VMAX. The valve is nearly fully open, that is, at or near position P2. The car descends, and, throughout the descent, the velocity is monitored through the POSITION signal. The valve is opened or closed by providing low rate SPEED signals (the CORRECTION signals) to hold the velocity close to VMAX. As the floor is approached, the slowdown signal is again received at some distance from the floor. At that point, the position of the valve P02 is immediately known through the total number of steps that have been made by the motor up to position P02 (at time T5) plus or minus the CORRECTION signal steps, which may move the valve in either direction to "fine tune" the flow. The final position of the valve P1A, which is close to the fully-closed position P1, is computed by taking into account delays such as floor position sensor dimensions. By making it somewhat less than the position P1, the valve is not opened prematurely, which would cause the car to stop before the floor level is reached. The distance between P03 and P1A is then computed, and roughly 10% of that distance is used for jerk-in and jerk-out stages. The jerk-out and jerk-in stages are carried out using recomputed rates S0"-S3". These are increased proportionally to bring the rate to S04" within the bands that define the 10% jerk-in and jerk-out segments.

At position P1A, the valve is not fully closed, and the car creeps slowly to the floor level, a short distance. The car is stopped at the floor by closing the MV and then closing the CV valve, by removing the LOWER signal.

Figure 4A:
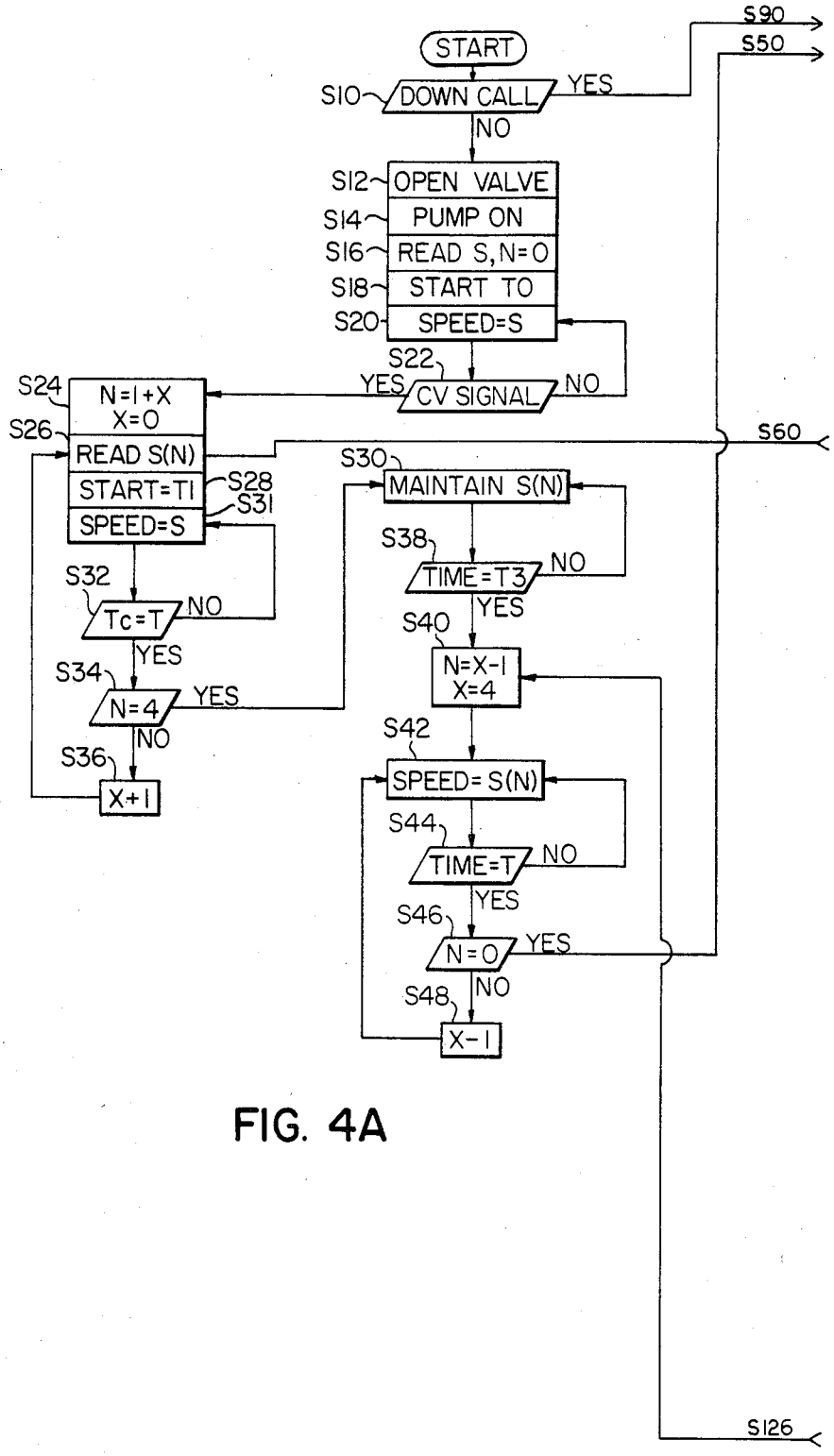
FIGS. 4A, 4B and 4C are a flowchart of processor routines used to control the stepper motor to achieve the desired car velocity profiles on up and down elevator runs between floors.
Figure 4B:
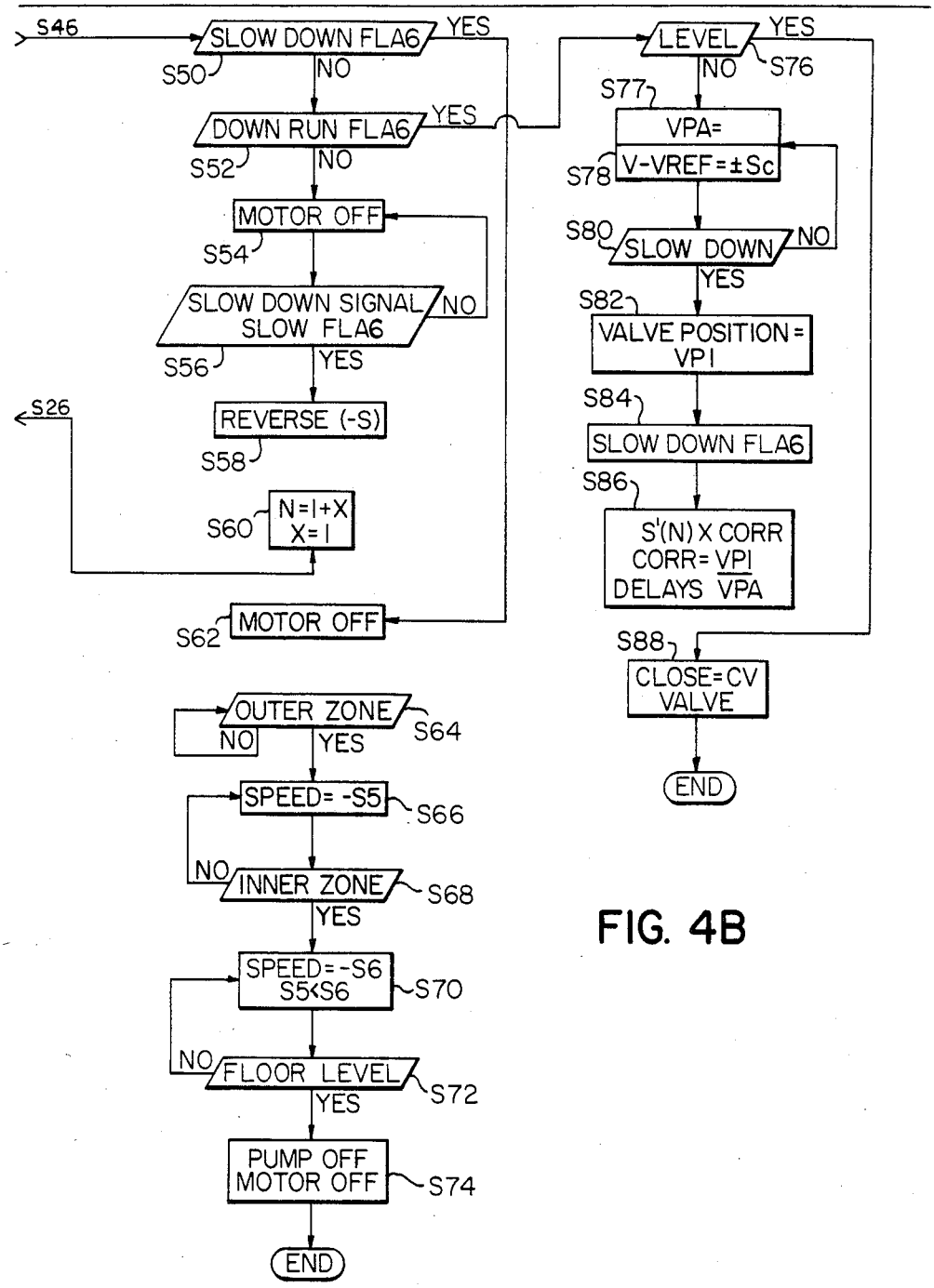
Figure 4C:
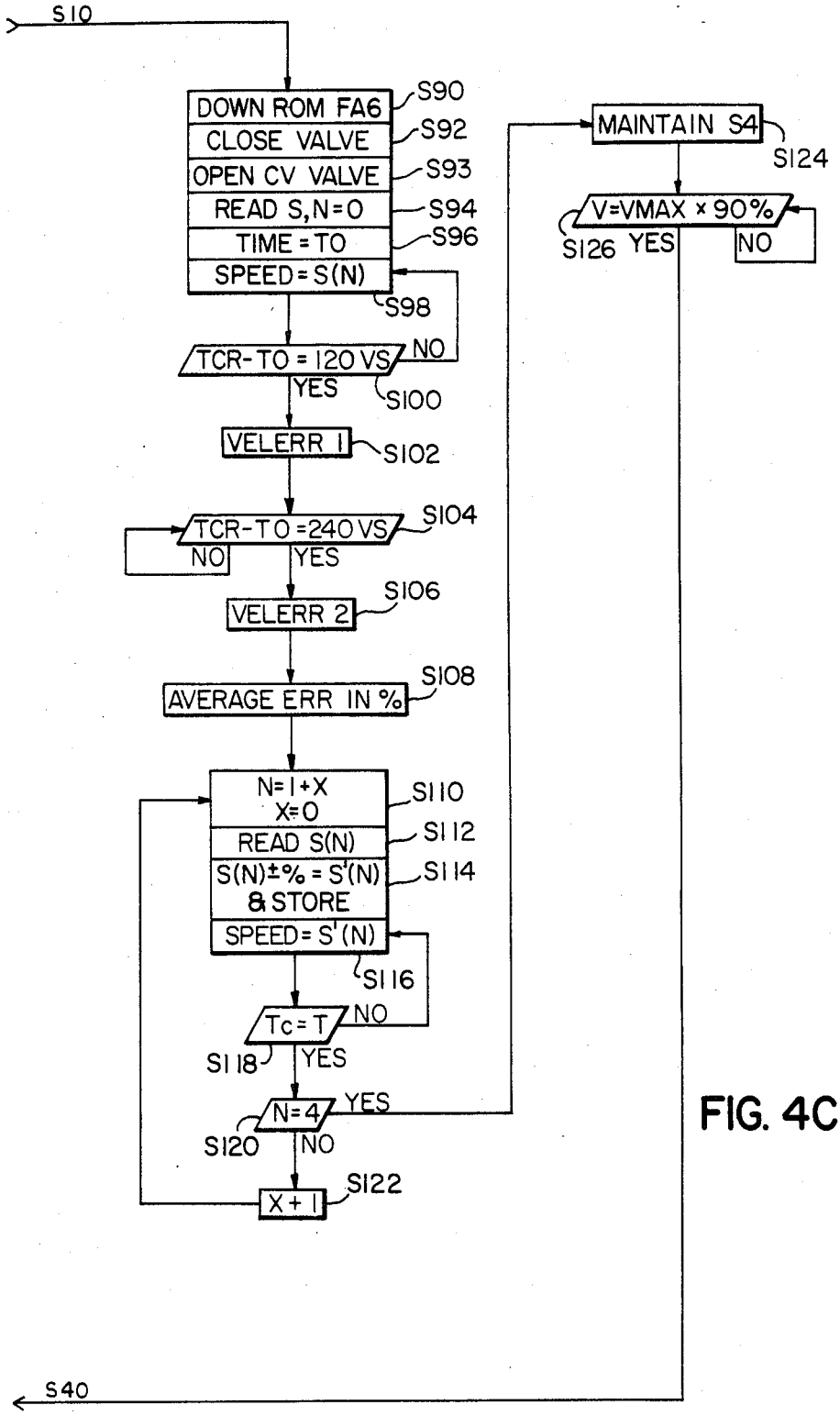

Referring back to FIG. 1, it shows a system using a computer for implementing this type of valve operation. Specifically, the PVC includes a processor 17*a*, which contains a CPU 17*a*1, a CPU clock 17*a*2, a CPU RAM 17*a*3, and an input/output terminal 17*a*4 through which signals are received and transmitted from the CPU. The CPU receives, through the input/output port, car calls and hall calls, the POSITION signal, and the CV signal. The CPU provides, through the input/output port, the LOWER signal through a buffer driver 17*d*. It similarly provides the SPEED signal through a buffer 17*c* and the pump on/off signal through a buffer 17*b*. The CPU is connected to an EPROM 17*c* that contains the stored parameters on the motion of the valve for computing the rates S1, S2, S3, and S4 at the beginning of an elevator run. The calculation of those rates is made simply from the basic speed profile, which is stored in the EPROM. The mathematical steps or algorithms for performing that calculation are well known and easy to accomplish for one skilled in computer processing techniques, and, for that reason, the calculation process has not been described in depth. The description assumes that those rates are initially calculated at the beginning of a run and are then "read" for performing the special sequences that characterize the invention. The valve positions when the valve 27 is open and closed are also stored in the EPROM (in terms of the number of motor 28 steps associated with each position). (A backup position sensor may be connected to the valve to show the open and closed positions, as well as "dead-band" portions, in which the valve motion produces no perceptible effect on fluid flow.) The flowchart shown in FIG. 4A, B describes the process that may be used in programming the CPU to achieve the desired type of elevator control described above.

The process for controlling the valve begins with the entry of a call, which may be either an up call or a down call. In step S10, a determination is made as to whether it is a down call or an up call. If it is a down call, the test at step S10 is negative, and the procedure begins at step S90, which is described in greater detail below. Assuming that it is an up call, then the test for a down call is negative and the procedure goes to step S12, and in this step the valve 27 is moved towards position P2 at which it is fully opened. The pump is then turned on in step S14, and the fluid flows through the valve back to the tank. The initial stepper motor rate SMAX is read by designating N=0 in step 16, and in step 18 the computer clock is set to T0. In step 20 the stepper motor speed signal is commanded at the rate S for N=0, and in step S27 a test is made to determine whether the CV signal has been produced, and if it is not, the SPEED signal remains at SMAX. An affirmative answer to the test at S22, which indicates that the CV signal has been provided, leads to step S24, at which N is selected by using the formula $N=1+X$, with X being initially selected as zero, and therefore being 1. In step S26, the computer is queried to determine the speed rate for S with N equaling 1 (S1 as used previously in this description). In the next step S28, the time counter is started at T1, and in step S30, S1 is given to the SPEED signal. In step S32, a measurement is made to determine the duration of the SPEED signal, which should be T. Until such time that T occurs, the SPEED signal continues to be generated. Once the time duration T has been reached, a test is made in step 34 to determine which stage the jerk-in SPEED signal program is at. There are four stages beyond the S0 stage, and, as mentioned previously, S4 defines the constant acceleration portion. If N is not equal to four in step S36, X is incremented by one unit, and the process returns to step S26, as a result of which S2 will become the SPEED signal rate. When N equals 4, it means that S4 has been utilized for the duration of time T. S4 continues to be produced, as indicated by step S36, and in step S38 a test is made to determine if time T3 has been reached. That is the time at which the jerk-out stage should commence. Until such time as T3 occurs, the speed rate remains at S(N), with N equaling 4. An affirmative answer to the test at step S38 leads to step S40, which is intended to produce a reversal of the sequence by which the SPEED signal was programmed from S0 to S4. In step S40, N is defined as equaling X−1, and X is first assigned the value of 4. In step S42, the SPEED signal is given the value for S of N, with N equaling 3, as identified by the equation in step S40. The SPEED signal is maintained until an affirmative answer is given to the test at S44 that the time duration equals T. In step S46, a test is made to determine whether N is equal to zero, that being the last rate in the jerk-out phase. If the answer is in the negative, X is incremented down by one in step S48, and then the process returns to step S42, at which the SPEED signal is given the new value, which in this case would be S2. An affirmative answer to step S46 indicates that the jerk-out phase has been completed, and the process then goes to step S50, which asks whether a slowdown flag has been obtained. The slowdown flag is a stored signal indicating that the slowdown position has been reached. At this point, the elevator car is moving at maximum velocity in the up direction and is approaching the slowdown point. Thus, S40 yields a negative answer. An additional test is made at step S42 to determine whether a down-run is underway. This is an up-run, and therefore the answer is negative, and the process goes to step S44, at which time the stepper motor is turned off. Consequently, the valve position is stationary at this point, and due to the number of increments that have occurred in the jerk-in acceleration and jerk-out stages, the valve is virtually at position P1. A test is made in step S46 to determine if the slowdown position has been reached. A negative answer requires that the motor continues to be turned off. An affirmative answer proceeds to step S58, which involves an initialization procedure by which the SPEED signals are reversed (minus S) for the purpose of moving the valve in the opposite direction in response to the speed rate signals. This is necessitated, as explained previously, because at this stage the valve must now be moved from the closed position to the open position for the purpose of slowing the car down and leveling it at the floor. Step S60 establishes the initial value for N. As previously, N is defined here by 1+X, X equaling 1 as an initial value. Using this calculated parameter for N, the procedure now goes back to step S26. In step S56, a slowdown flag was stored in response to the slowdown signal. Thus, upon the completion of step S46, which occurs during the jerk-out phase during deceleration, an affirmative answer is produced in step S50. The process then goes from step S50 to step S62, at which the motor is turned off. The car is approaching the floor at this point, and a determination is made as to whether it has reached the outer zone, this occurring in step S64. An affirmative answer moves the process along to step S66, at which the SPEED signal is given a prestored value of −S5, which is a preselected high reverse rate. This reverse rate of −S5 continues until the test of S68, which determines whether the car has reached the inner zone, provides an affirmative answer. Then in step S60, the speed is increased to an even higher reverse rate of −S6, this occurring in step S70. When the floor level is reached, the test in S72 produces an affirmative answer which causes the pump to be turned off and the motor to be turned off at step S74, and then the up-run has been completed and the process ends.

If step S10 yielded an affirmative answer, which would indicate that the car was going down, the process would go from step S10 to S90. Step S90 sets a down-run flag indicating that the car is moving down in response to a down hall call or a down car call. The valve is then immediately fully closed in step S92, and the CV valve is opened in step S93, by the CPU providing the LOWER signal. At step S94, the CPU reads the stored value S for N equaling 0, and the time is set at T0 in step S96. As before, the speed is then given the rate of S(N), N equaling zero, or S0 as defined previously. At this point, the car begins to gather speed, and the valve is opening at the rate S0. A test is made in step S100 to determine whether 120 milliseconds had passed since time T0. When 120 milliseconds passes, the difference between the desired elevator velocity and the velocity represented by the position signal is stored, it being known as the VELERR 1. If the time that has elapsed since T0 is 240 milliseconds as measured in step S104, another velocity error signal, VELERR 2, is assigned in step S106. Then in step S108, the average of VELERR 1 and VELERR 2 is obtained and stored as a percentage figure. Step S110 is an initialization procedure for assigning N, which is used, as described previously, to determine which of the rate signals to use. This initially takes place with X starting out as zero. Then in step S112, the speed rate signal S(N) is read, and since X is zero, this would be S1. Before the motor speed is commanded, S1 is adjusted by the percentage of the error signal to either a higher or lower value, depending upon the percentage. If the car was moving faster than expected, then S1 will be reduced. If the car was moving slower than expected, S1 will be increased. The result of this correction is S'(N), and in step S116, the SPEED signal is dictated as S'(N), which in this case is S1 plus the percentage of overspeed or underspeed. A test is made in step S118 to determine the duration of the SPEED signal. When the duration is T, a test is made at S120 to determine if N is four, once again, because there are four steps beyond S0 in the jerk-in phase. Since in this example N is equal to one, X is incremented one step in step S122, and then the process repeats until such time as N equals four. At that point, the SPEED signal is S'4, which is the adjusted maximum acceleration rate. Step S124 identifies the procedure for maintaining S'4. In step S126, a test is made that determines if the car velocity V has achieved 90% of the stored VMAX, which is the maximum down velocity for the car. An affirmative answer to this test makes the procedure go to step S40, which involves the jerk-out phase during acceleration. This procedure was explained previously, except it should be understood that the figures that are used for the jerk-out are now S'N. When the jerk-out phase is completed and the car is found not to be at the level position in step S76, the position of the valve is stored as VPA at step S77. This identifies the position of the valve just after the jerk-out phase. In step S78, the error between the stored velocity and a reference velocity is obtained and stored as plus or minus SC, and the SC signal is commanded to the speed control to move the valve between positions P1 and P2 in small increments so as to keep the difference between the velocity and the referenced velocity within the error limits of the closed-loop system that is in place during this mode of operation. Eventually, step S80 yields an affirmative answer, indicating that the slowdown position has been reached. At that point, the valve position is noted as VP1. Then in step S84, the slowdown flag is set. In step S86, the signals S'(N) are multiplied by a correction CORR. That correction is intended to increase or decrease the rate of the steps in order to move the valve to position PIA (see FIG. 3) so that approximately 10% of the time is spent on the jerk-in and jerk-out stages. Once step S86 is completed, the speed values S''(N) are reversed in step S58 (they are given a negative value because the valve has to move in the opposite direction, and, from S58 on, the jerk-out phase continues as before, but with the new values −S''(N). Eventually, test S76 indicates that the car is at the level zone that is near the floor, and the affirmative answer then produces the fixation or termination of the LOWER signal in step S88, at which point the car stops. Then the process ends with the car being level at the floor.

The preferred embodiment of the invention has been disclosed and explained, but one of ordinary skill in the art to which the invention relates may make modifications and variations in the embodiment, in whole or part, without departing from the true scope and spirit of the invention.

We claim:

1. An elevator comprising:

a car;

a hydraulic actuator having a piston that is extended and retracted to raise and lower the car;

a position sensor for providing a position signal that manifests the velocity and position of the car;

a hydraulic fluid tank;

a hydraulic fluid pump;

a hydraulic valve for regulating the flow of fluid between the pump and the actuator to raise the car and between the actuator and the tank to lower the car;

processing means for controlling the operation of the hydraulic valve and the pump in response to hall and car calls and the position signal;

the elevator being characterized in that:

the valve comprises a single flow control valve that is movable in a first direction to increase flow from the pump to the actuator and simultaneously equally decrease a flow bypassed from the pump to the tank to control the ascent velocity of the car when the pump is on and that is movable in an opposite second direction when the pump is off, to decrease the flow from the actuator to the tank to control the descent velocity of the car, and means for providing a control signal that manifests that the pump out pressure applied to the car has exceeded the pressure required to hold the car in place;

an electrical actuator that is connected to the single control valve and that responds to a speed signal by moving the valve in the first direction when the speed signal is one polarity and in a second direction opposite the first direction when the speed signal is of the opposite polarity;

the processing means comprises means for providing the speed signal at a first magnitude after the pump is activated and then in a succession of different magnitudes that define, over time, the car velocity profile in response to the control signal.

2. An elevator according to claim 1, characterized in that:

the electrical actuator comprises a stepper motor;

the processing means comprises means for providing the speed signal at said first polarity according to a first sequence in which it has first frequency, then a first succession of higher frequencies, each for a fixed time interval initiated in response to the check valve signal until a preselected maximum frequency is reached for then maintaining the speed signal at that maximum frequency for a predetermined number of steps for then providing the speed signal at successive frequencies in a second sequence in which the frequencies are the same as the first sequence and decrease from the maximum to the first frequency, the duration of the speed signal at each frequency in the second sequence being said predetermined time interval.

3. An elevator according to claim 2, characterized in that:

the means for providing the control signal comprises a check valve in line with the actuator and a switch that is operated by the check valve when the check valve opens for flow to the actuator, the switch providing a check valve signal when the check valve operates.

4. An elevator according to claim 2, characterized in that:

the processing means comprises means for providing, while the pump is on, the speed signal at said second polarity at a plurality of successively higher frequencies after the motor has been turned off following car deceleration, the speed signal at said second polarity being provided at the highest of those frequencies until the car is at floor level.

5. An elevator according to any one of claims 1–4, characterized in that:

the processing means comprises means for providing the speed signal in a sequence that defines the car velocity when the car is lowered by providing the speed signal at a first rate of change for a fixed sampling interval of time and thereafter providing the speed signal at different rates, each for the same time intervals, those rates being the product of a preset rate and an adjustment signal, and for providing said adjustment signal by comparing the car velocity manifested by the position signal with a velocity reference signal during the sampling interval, said adjustment signal representing the ratio between the car velocity and the reference velocity.

* * * * *